US006926169B2

(12) United States Patent
Burato et al.

(10) Patent No.: US 6,926,169 B2
(45) Date of Patent: Aug. 9, 2005

(54) DEVICE FOR THE INSERTION OF AN ANTI-DRIP ELEMENT INTO THE MOUTH OF A BOTTLE

(76) Inventors: Piero Claudio Burato, Via Cabalao, 12, 37030 Montecchia di Crosara (Verona) (IT); Dietmar Schonhuber, Via Centrale, 19, 39031 Brunico (Bólzano) (IT)

( * ) Notice: Subject to any disclaimer, the term of this patent is extended or adjusted under 35 U.S.C. 154(b) by 0 days.

(21) Appl. No.: 10/899,414

(22) Filed: Jul. 26, 2004

(65) Prior Publication Data

US 2005/0023308 A1 Feb. 3, 2005

(30) Foreign Application Priority Data

Jul. 30, 2003 (IT) ..... VI2003A0157

(51) Int. Cl.[7] ..... B67B 7/00
(52) U.S. Cl. ..... 222/1; 222/569; 24/27
(58) Field of Search ..... 222/569, 1; 24/27

(56) References Cited

U.S. PATENT DOCUMENTS 503,683 A * 8/1893 Robertson ..... 24/72.1
2,193,805 A * 3/1940 Deschner ..... 222/562
2,435,033 A * 1/1948 Campbell ..... 215/387
2,524,562 A * 10/1950 Dawbarn ..... 137/231
3,131,444 A * 5/1964 Manning ..... 24/27
4,099,298 A * 7/1978 Gimenez ..... 24/27
4,107,824 A * 8/1978 Lussier ..... 24/27
5,125,244 A * 6/1992 Zwart ..... 63/14.1
5,651,481 A * 7/1997 Jensen ..... 222/566
5,979,718 A * 11/1999 Jinathan ..... 222/567
D418,753 S * 1/2000 DuBow ..... D9/440
6,073,816 A * 6/2000 Granberg ..... 222/566

FOREIGN PATENT DOCUMENTS

EP 560777 B1 * 1/1997 ..... A47G/19/30

* cited by examiner

*Primary Examiner*—Kenneth Bomberg
(74) *Attorney, Agent, or Firm*—Bucknam and Archer

(57) ABSTRACT

A device is disclosed for the insertion of an anti-drip element into the mouth of a bottle having a structure made from elastic metal wire, which is configured, at its intermediate portion, like a circular helix (1), which completes at least one loop. The ends of the helix extend, in opposite directions, with two mutually diverging extensions (2, 3). When the free ends (2', 3') of the extensions (2, 3) are brought together there is a slight widening of the circular helix, which can therefore be taken away from the anti-drip element (4), after the latter has been correctly positioned in the mouth of the neck of the bottle.

4 Claims, 1 Drawing Sheet

DEVICE FOR THE INSERTION OF AN ANTI-DRIP ELEMENT INTO THE MOUTH OF A BOTTLE

FIELD OF THE INVENTION

The present invention relates to a device suitable for allowing the insertion of an anti-drip element into the mouth of a bottle.

BACKGROUND OF THE INVENTION

It is known that one of the problems encountered in pouring drinks, in particular wine, in bars, in restaurants and at home, consists of the fact that there is almost always the formation of one or more drips on the mouth of the bottle. Such drips are destined to fall directly onto the table, possibly covered by a tablecloth, or else it may run down the outer surface of the bottle. Of course, the stains that are thus formed cause aesthetic problems, above all in the case in which red wine is being poured.

As an example, we quote the fact that to avoid these drawbacks the device described in European patent no. 0560777 has been devised, which, in a very simple manner, is able to effectively solve the problem. In practice, this concerns a simple circle made from a suitable plastic material, which, after having been rolled up, so as to form a sort of cylindrical structure, is slotted into the mouth of the bottle. Thanks to the presence of this structure, the flow of drink that is poured from the bottle is, as one says, "cut off" when one has finished pouring the drink into the glass and then one lifts the mouth of the neck of the bottle. Indeed, there is no longer the formation of drips, liable to fall onto the tablecloth. This device is distributed and sold arranged inside an openable card package, which also ensures its hygiene and, in public spaces, it is inserted into the mouth of the bottle in the presence of the customer, naturally after having opened the bottle, an operation that is always carried out in front of the customer.

The use of this device does, however, have one drawback, in particular in public spaces, consisting of the fact that the sommelier or the waiter that carries out the operation of inserting the anti-drip element inside the mouth of the bottle must necessarily grip the element with his/her hands to be able to slot it into position.

This, of course, is not very pleasant for dinner guests, in particular if, as almost always is the case, the operator does not use gloves for practical reasons, since his bare hands will touch an object that is going to come into direct contact with the drink that shall then be drunk by the diners.

SUMMARY OF THE INVENTION

The object of the present invention is that of providing a device suitable for allowing easy insertion both of the anti-drip device described previously and of similar devices that have been or that shall be devised, into the mouth of the neck of a bottle.

This object is accomplished, according to the present invention, by providing a structure made from elastic metal wire, which is configured, at its intermediate portion, like a circular helix, which completes at least one loop and the two ends of which extend, in opposite directions, with two mutually diverging extensions. It is also foreseen that if the ends of said extensions are brought together there is a slight widening of the circular helix.

In practice, the anti-drip device is previously arranged inside the circular helix suitably rolled up, the device according to the invention in practice acting as a calliper. After the bottle has been taken to the table of the diners determining the slight widening of the circular helix, which causes the freeing of the circular the anti-drip element, which remains slotted by itself in the neck of the bottle.

Thanks to such maneuvers one avoids having to touch the anti-drip element with one's hands, which allows the aforementioned hygienic and image drawbacks to be avoided.

BRIEF DESCRIPTION OF THE DRAWINGS

The present invention shall now be illustrated and described in detail, in one particular embodiment thereof, given only as a non-limiting example, with the help of the attached drawings, in which.

DETAILED DESCRIPTION OF THE INVENTION

Figure 1:
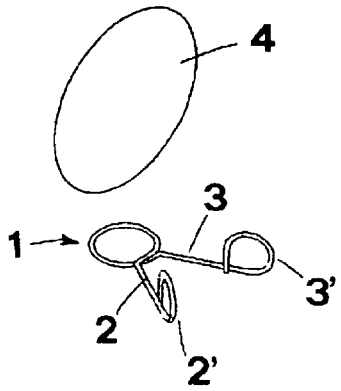
FIG. 1 is a perspective view of the device according to the present invention, prior to the insertion of the anti-drip element.

In FIG. 1 it can be seen that the device according to the present invention is a structure made from elastic metal wire that is configured, at its intermediate portion, like a circular helix 1, which completes at least one loop, the two ends of which extend, in opposite directions, with two mutually diverging extensions 2 and 3.

The structure of the device is such that, if said extensions are brought together, a slight widening of the circular helix 1 results.

From the practical point of view, the anti-drip element 4 described previously can easily be arranged inside the circular helix 1, naturally after having been duly rolled up. It should, however, be specified that any anti-drip element can be housed inside the device, even one that is different from the structural and functional point of view with respect to the one described previously, provided that it is able to carry out the same function.

Figure 2:
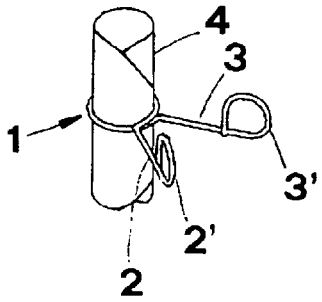
FIG. 2 is a perspective view of the device according to the present invention, in which the anti-drip element has already been inserted.
Figure 3:
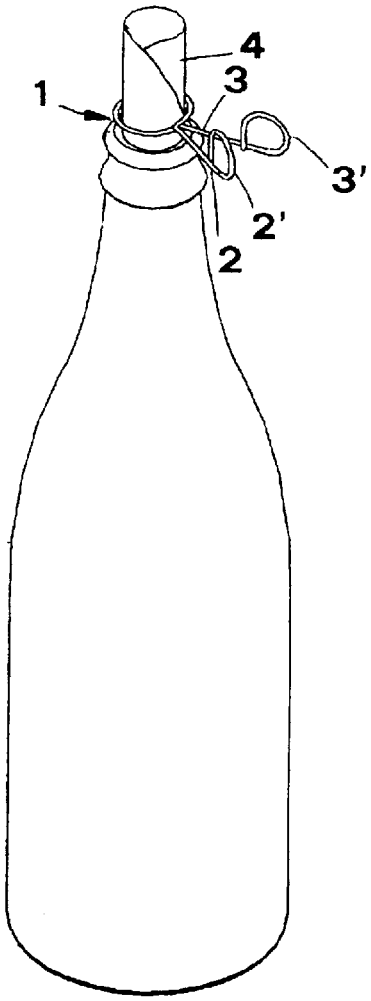
FIG. 3 is a perspective view of a bottle, inside the mouth of which an anti-drip element has been inserted, still placed in the device according to the present invention; and, FIG. 4 is a perspective view of a bottle, inside the mouth of which an anti-drip element has been inserted, where the latter has already been removed from the device according to the present invention.
Figure 4:
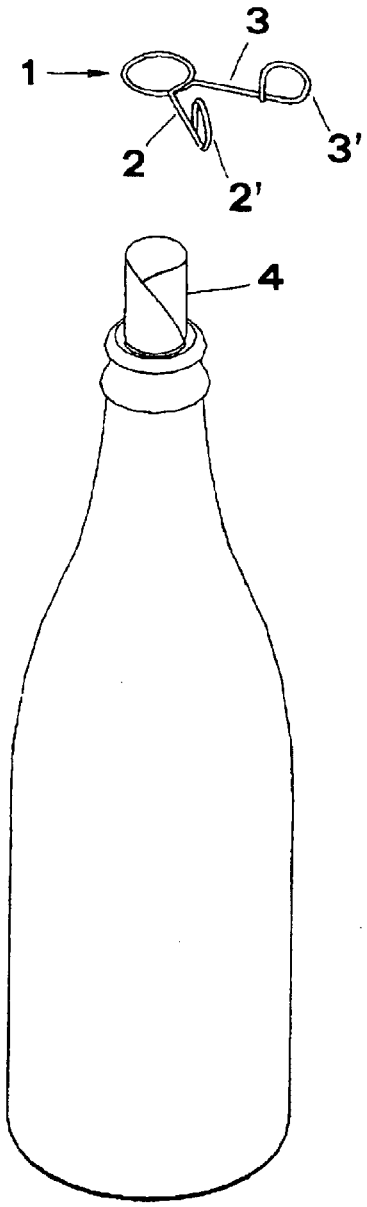

The anti-drip device, however configured, shall be arranged in the position illustrated in FIG. 2 before bringing the bottle to the table. Then, after the bottle has been taken to the table and has been opened, the anti-drip device (FIG. 3) is positioned in the mouth of the bottle. Finally, the two extensions 2 and 3 are brought together, slightly widening the circular helix 1, so that the invention can be moved away from the anti-drip device (FIG. 4), which shall of course remain in loco to carry out its function.

To ease the bringing together of the two extensions 2 and 3, their free ends 2' and 3' advantageously have widened means to ease gripping by the user's fingers. Advantageously, these widened means shall consist of the free ends of said extensions, suitably bent in a substantially circular shape.

From the above it can therefore be seen how the entire operation can take place in front of customers without ever touching the drip-catching device with fingers. Everything takes place through a device that is constructively and functionally fairly simple, which certainly allows us to state that the objects set previously have been obtained.

It should be remembered that the device according to the present invention can take up different shapes and appearances with respect to that which has been illustrated and described previously, with its essential characteristics remaining unchanged, without for this reason departing from the scope of protection of the patent.

What is claimed is:

1. In combination, an anti-drip element for insertion into the mouth of a bottle and a device adapted for inserting said anti-drip element into the mouth of the bottle, comprising:

an anti-drip element formed of a flat plastic sheet rolled-up to form a substantially cylindrically shaped structure adapted to elastically engage the mouth of the bottle upon insertion thereinto to thereby form a pour spout; and a device adapted for inserting said anti-drip element into the mouth of the bottle, said device being formed of elastic metal wire configured in the form of a circular helix (1) completing at least one loop, two ends of said metal wire extending in opposite directions with two mutually diverging extensions (2, 3), whereby the bringing together of said extensions (2, 3) causes a slight widening of the circular helix (1);

said rolled-up plastic sheet being adapted to fit within said circular helix (1) of the inserting device so that the cylindrically shaped structure thereof may be inserted into the mouth of the bottle by manipulating the inserting device without touching the anti-drip element and the inserting device removed therefrom by bringing together said extensions (2, 3) of said device to disengage the circular helix (1) from the anti-drip element.

2. The combination as defined in claim 1, wherein the ends of the extensions (2, 3) of the inserting device comprise widened means so as to make it easier for the user to bring them together.

3. The combination as defined in claim 2, wherein said extensions (2, 3) of the inserting device have free ends (2', 3') bent over on themselves to form substantially circular-shaped structures.

4. A method for inserting an anti-drip element into the mouth of a bottle, comprising:

providing an anti-drip element in the form of a flat plastic sheet movable from a flat position to a rolled-up substantially cylindrically shaped structure adapted to elastically engage the mouth of the bottle upon insertion thereinto to form a pour spout;

providing a device adapted for inserting said anti-drip element into the mouth of the bottle, said device being formed of elastic metal wire configured in the form of a circular helix (1) completing at least one loop, two ends of said metal wire extending in opposite directions with two mutually diverging extensions (2, 3);

engaging said rolled-up substantially cylindrically shaped structure of the anti-drip element within the circular helix (1) of the inserting device;

inserting said rolled-up substantially cylindrically shaped structure of the anti-drip element engaged within the circular helix of the inserting device into the open mouth of the bottle by manipulating said inserting device without touching said anti-drip element; and disengaging the circular helix of the inserting device from the rolled-up substantially cylindrically shaped structure of the anti-drip element by bringing together said extensions (2, 3) of said inserting device to cause a slight widening of the circular helix (1) to thereby disengage the circular helix (1) of the inserting device from the anti-drip element.

* * * * *